US005459278A

United States Patent [19]

Hsu

[11] Patent Number: 5,459,278

[45] Date of Patent: Oct. 17, 1995

[54] WINDING DEVICE FOR MUSIC BOXES

[76] Inventor: Ping-Tsung Hsu, No. 8, Lane 1, Chung Hsing Road, Sec. 1, Wuku Hsiang, Taipei Hsien, Taiwan

[21] Appl. No.: 367,080

[22] Filed: Dec. 30, 1994

[51] Int. Cl.[6] ..... G10F 1/06; G09F 27/00; A63H 18/14

[52] U.S. Cl. ..... 84/95.1; 84/95.2; 446/298; 446/303; 40/455

[58] Field of Search ..... 84/95.1, 95.2, 84/94.1, 94.2; 446/298, 303; 40/455

[56] References Cited

U.S. PATENT DOCUMENTS 2,501,822 3/1950 Kuyler ..... 84/95.2

3,410,169 11/1968 Kobayashi ..... 84/95.2

*Primary Examiner*—Kristine L. Kincaid
*Assistant Examiner*—Cassandra C. Spyrou
*Attorney, Agent, or Firm*—Bacon & Thomas

[57] ABSTRACT

A laterally disposed winding device for music boxes including an extended shaft, a driving gear, an idle gear, a crown gear, a securing frame and linking-up assembly. By turning a handle of the extended shaft, the driving gear brings the crown gear to rotate in a same direction via the idle gear, thereby tightening a spiral spring of the music box. When the spiral spring is released and a revolving axle thereof turns, the crown gear brings a cam on the idle gear to rotate so that a driven element and a reciprocating mechanism of the linking-up assembly respectively bring one of the figures on the music box to move up and down and the other to move backwards and forwards.

1 Claim, 4 Drawing Sheets

WINDING DEVICE FOR MUSIC BOXES

BACKGROUND OF THE INVENTION

The present invention relates generally to a winding device for music boxes, and more particularly to a laterally disposed winding device for music boxes.

When a conventional music box is placed on its bottom, the revolving axle of its spiral spring faces downward in a vertical orientation for a handle to be connected to the bottom end of the revolving axle, so that when the music box is installed at the bottom of a comparatively heavy ornament, the ornament has to be lifted up in order to turn the handle to tighten the spiral spring; it is very inconvenient in terms of use.

The present invention aims to improve the above drawback by providing a handle disposed at a lateral side of the ornament so that the winding up operation may be proceeded smoothly without the need to lift up the ornament.

Although this type of laterally disposed winding devices may be adapted in various mechanisms to achieve the same effect, the height of the music box and hence the height of the ornament's base will consequently be increased, raising the manufacturing cost.

SUMMARY OF THE INVENTION

The primary object of the present invention is to provide a winding device for a music box, wherein the height of the music box is slightly increased and the increased height may be absorbed by the base of the music box.

Another object of the present invention is to provide a laterally disposed winding device wherein a handle of an extended shaft and a revolving axle of a spiral spring turn in a same direction.

A further object of the present invention is to provide a winding device wherein after a spiral spring is tightened and is released subsequently, a linking-up means is driven to cause figures on the ornament to perform predetermined movements.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
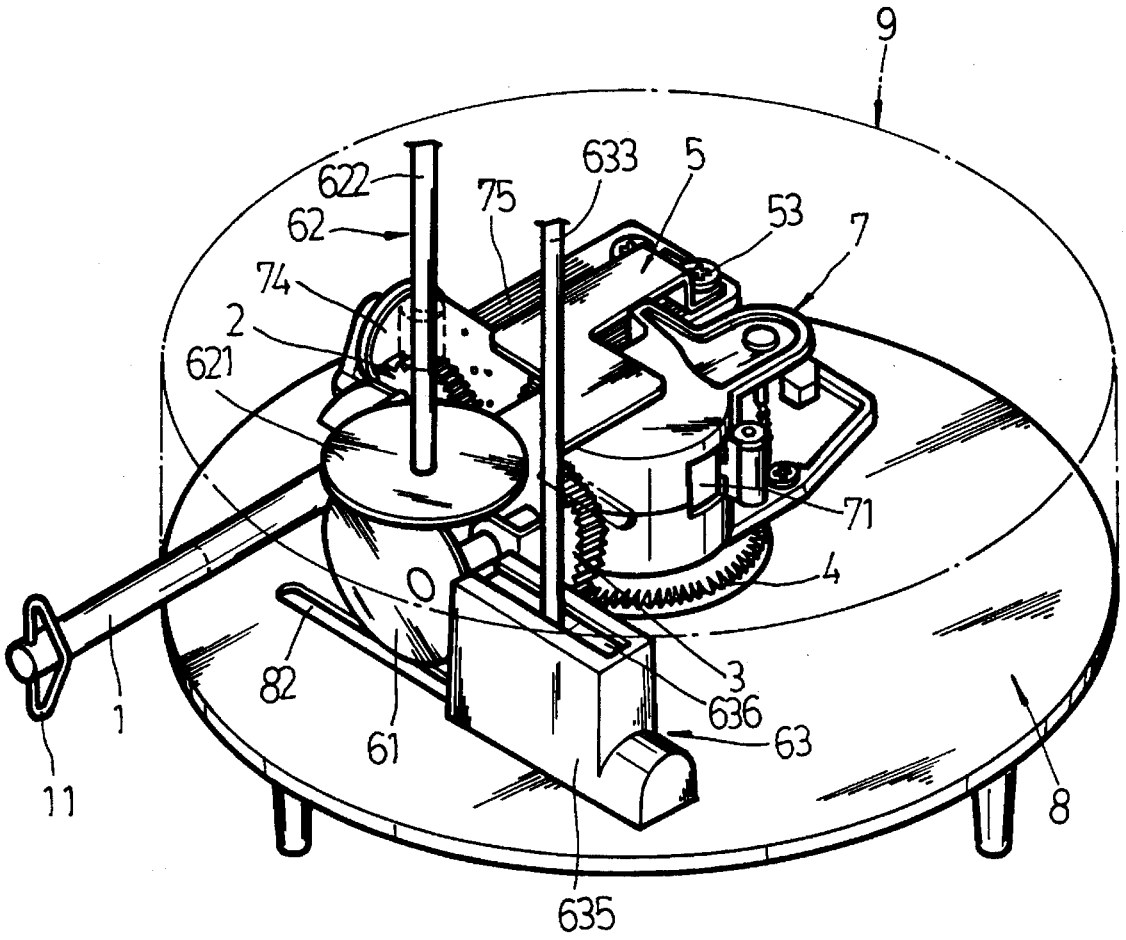
FIG. 1 is a perspective view of a preferred embodiment of the present invention disposed on a music box.
Figure 3:
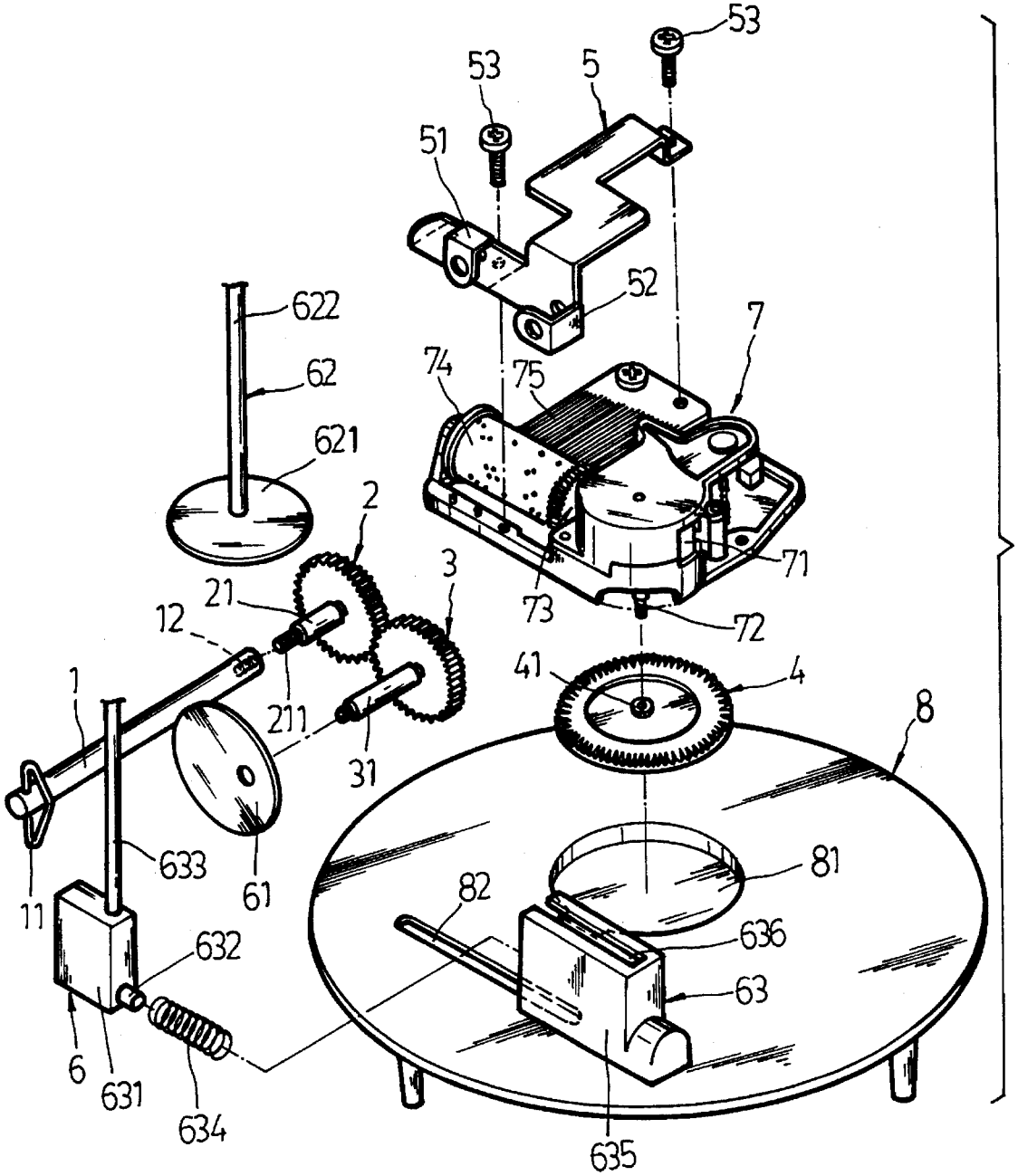
FIG. 3 is an exploded view of FIG. 1.

As shown in FIGS. 1 and 3, the music box referenced by 7 comprises a spiral spring 71, a revolving axle 72, a transmission mechanism 73, a tone programming drum 74 and tone reeds 75, wherein the spiral spring 71 is wound up by turning the revolving axle 72 of the spiral spring 71, and the kinetic energy released by the spiral spring 71 is transmitted via the transmission mechanism 73 to rotate the tone programming drum 74, causing the tone reeds 75 to produce a predetermined music sound. The above-mentioned arrangement is similar to that of conventional devices.

Figure 2:
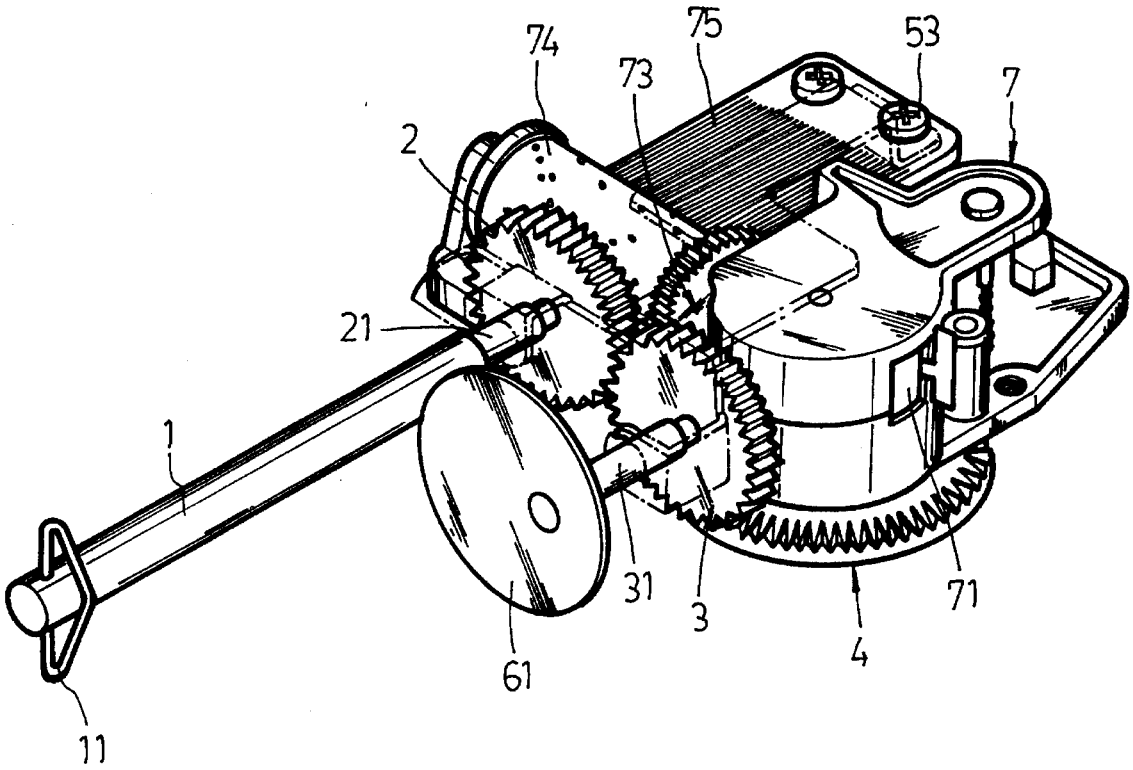
FIG. 2 is a perspective view of the main structure of the embodiment shown in FIG. 1.

With reference to FIGS. 1 to 3 again, the present invention is incorporated with the aforesaid mechanism, comprised of an extended shaft 1, a driving gear 2, an idle gear 3, a crown gear 4, a securing frame 5 and a linking-up means 6, wherein an outer end of the horizontally oriented extended shaft 1 is provided with a handle 11 which protrudes from the outside of the base 8 of the ornament. An inner end of the extended shaft 1 is provided with a threaded hole 12 for engaging with a threaded end 211 of a central axle 21 of the driving gear 2. When the handle 11 is turned clockwise, the threaded hole 12 engages with the threaded end 211 more tightly.

The above-mentioned driving gear 2 meshes with the idle gear 3. Therefore, when the driving gear 2 rotates clockwise, the idle gear 3 rotates counter-clockwise.

The idle gear 3 meshes with the crown gear 4 in a right-angle relationship. A socket 41 in the center of the crown gear 4 is screwably connected to the revolving axle 72. Therefore, when the idle gear 3 turns counter-clockwise, the crown gear 4, if observed from the bottom side thereof, turns clockwise. In other words, it turns in the same direction as when the spiral spring 71 is ordinarily wound up. Such a turning movement in the clockwise direction causes the revolving axle 72 and the socket 41 to be fitted together more tightly.

As mentioned above, when the handle 11 is turned clockwise, the crown gear 4 is caused to rotate in the same direction by means of the idle gear 3 so that the spiral spring 71 is sufficiently wound up.

The driving gear 2 and the idle gear 3 are supported and kept in position by means of the securing frame 5. The securing frame 5 has a pair of securing elements 51, 52 each of which having two coaxial holes for insertion of the horizontally oriented axle 21 of the driving gear 2 and the horizontally oriented axle 31 of the idle gear 3 respectively. Additionally, the securing frame 5 is fixed on the music box 7 by means of screws 53.

As the crown gear 4 is rather thin, it does not add to the overall height of the music box 7. When the music box 7 is Screwed and secured onto the base 8, the crown gear 4 may be placed in a recess 81 of the base 8 so that use of the winding device of the present invention will not increase the height of the base of the ornament.

Figure 4:
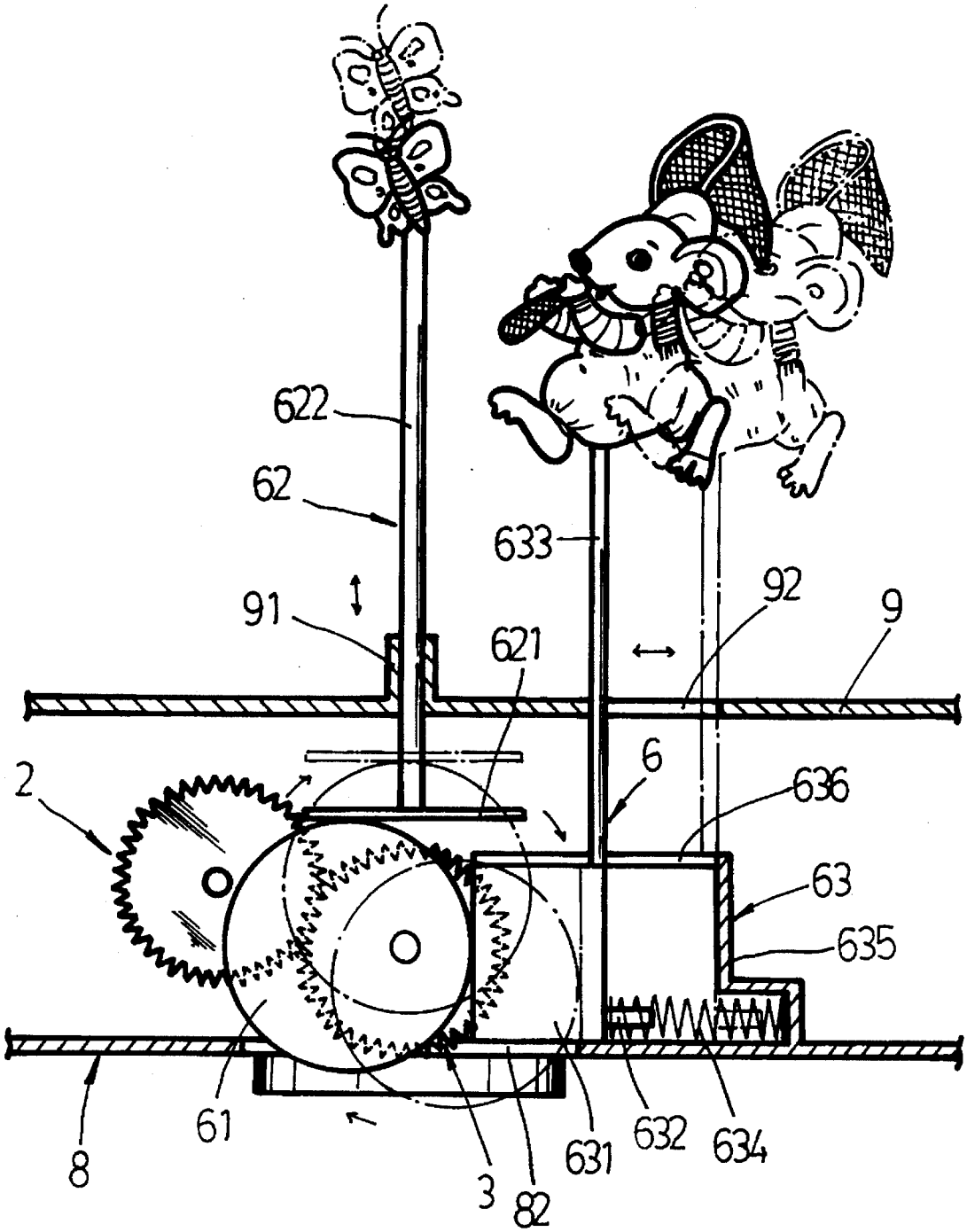
FIG. 4 is a schematic view showing the movement of the linking-up means.

With reference to FIGS. 1, 3 and 4, the linking-up means 6 of the present invention is connected to a cam 61 at an end of the axle 31 of an idle gear 3 and has a driven element 62 at an upper part of the cam 61. The linking-up means 6 further has a reciprocating mechanism 63 at a lateral side of the cam 61.

The driven element 62 consists of a baseplate 621 and a link 622. The link 622 is inserted through a sleeve 91 of a lid 9. When the cam 61 turns, the driven element 62 moves up and down, hence a toy figure on the link 622 also moves up and down.

The reciprocating mechanism 63 of the present invention consists of a slide block 631, a nose 632, a link 633, a spring 634 and a casing 635, wherein the slide block 631 is disposed inside the casing 635 and may freely reciprocate. The spring 634 is fitted onto the nose 632 so that by pressing the spring 634, the slide block 631 may be reset to its original position due to the action of the spring 634.

The casing 635 has a narrow opening 636 in an upper end thereof for permitting movement of the cam 61 and the link 633 therein. In addition, the base 8 also has an elongated slot 82 in which the cam 61 may move.

When the cam 61 turns, it not only brings the driven element 62 to move up and down, but it also causes the slide block 631 and link 633 to reciprocate, thereby the toy figure on the link 622 moves up and down whilst that on the link 633 moves back and forth. This arrangement of movement in different orientations enhances the fun in play.

The operation of the present invention is briefly summarized as follows: when the handle 11 is turned, the driving gear 2 brings the crown gear 4 to turn therewith via the idle gear 3, thereby winding up the spiral spring 71; when the spiral spring 71 is released, the revolving axle 72 is caused to rotate in a reverse direction and brings the idle gear 3 and the cam 61 to turn therewith via the crown gear 4, causing the driven element 62 to move up and down and the reciprocating mechanism 63 to reciprocate, so that the figure on the link 622 moves up and down whilst that on the link 633 moves back and forth.

Although the present invention has been illustrated and described with reference to the preferred embodiment thereof, it should be understood that it is in no way limited to the details of such embodiment but is capable of numerous modifications within the scope of the appended claims.

What is claimed is:

1. A laterally disposed winding device for a music box, said device comprising:

a driving gear having a horizontally oriented axle which is connected to an extended shaft having a handle;

an idle gear meshing with said driving gear and having a horizontally oriented axle;

a crown gear, the center thereof connected to a vertically oriented revolving axle of a spiral spring of said music box, and said crown gear meshing with said idle gear in a right-angle relationship;

a securing frame locked on said music box and having two positioning elements for positioning the axles of said driving gear and said idle gear respectively; and linking-up means disposed on said axle of said idle gear and having a cam, said cam having a driven element at an upper part thereof and a reciprocating mechanism at a lateral side thereof, wherein by means of turning said handle of said extended shaft, said driving gear brings said crown gear to rotate in a same direction via said idle gear so as to tighten said spiral spring of said music box, and when said spiral spring is released so that said revolving axle turns, said cam on said idle gear is caused to turn via said crown gear so that said driven element moves up and down and said reciprocating mechanism moves backwards and forwards.

* * * * *